US005465794A

United States Patent [19]

McConaughy et al.

[11] Patent Number: 5,465,794

[45] Date of Patent: Nov. 14, 1995

[54] HYDRAULIC SEAL BETWEEN TUBING HANGER AND WELLHEAD

[75] Inventors: Brett R. McConaughy, Jurong, Singapore; Norman Brammer, Aberdeen, Scotland; James A. Gariepy, Houston, Tex.

[73] Assignee: ABB Vetco Gray Inc., Houston, Tex.

[21] Appl. No.: 294,679

[22] Filed: Aug. 23, 1994

[51] Int. Cl.[6] ..... E21B 34/10

[52] U.S. Cl. ..... 166/375; 166/382

[58] Field of Search ..... 166/373–375, 166/382, 344, 368, 341; 285/133.2, 137.2

[56] References Cited

U.S. PATENT DOCUMENTS

| | | | |
|---|---|---|---|
| 4,219,223 | 8/1980 | Schulte | 285/26 |
| 4,333,526 | 6/1982 | Watkins | 166/87 |
| 4,449,583 | 5/1984 | Lawson | 166/72 |
| 4,458,903 | 7/1984 | Tohill | 166/75.1 X |
| 4,607,691 | 8/1986 | Bridges | 166/88 |
| 4,616,857 | 10/1986 | Woodman et al. | 285/140 |
| 4,796,922 | 1/1989 | Prichard | 285/26 |
| 5,372,199 | 12/1994 | Cegielski et al. | 166/368 |

FOREIGN PATENT DOCUMENTS

0572732A1 8/1993 European Pat. Off. .

*Primary Examiner*—Roger J. Schoeppel
*Attorney, Agent, or Firm*—James E. Bradley

[57] ABSTRACT

An annular wellhead member has an inner mating surface. The wellhead member has a hydraulic fluid passage with an inboard opening at the inner mating surface. A tubing hanger is landed concentrically within the wellhead member. The tubing hanger has an outer mating surface which mates with the inner mating surface of the wellhead member. A production fluid passage through the tubing hanger places the production tubing string in communication with a production line. A hydraulic line extends from a hydraulically operated downhole safety valve to the tubing hanger. A tubing hanger hydraulic fluid passage has a first opening and an outboard opening. The first opening is connected to the hydraulic line. The outboard opening is located on the outer mating surface of the tubing hanger and registers with the inboard opening of the wellhead member hydraulic fluid passage. The wellhead member hydraulic fluid passage is connected to a hydraulic supply line. An alignment device aligns the outboard opening of the tubing hanger hydraulic fluid passage and the inboard opening of the wellhead member hydraulic fluid passage. A seal ring is concentrically located around the openings. Hydraulic fluid is supplied from the exterior of the wellhead member to the downhole safety valve.

7 Claims, 3 Drawing Sheets

HYDRAULIC SEAL BETWEEN TUBING HANGER AND WELLHEAD

BACKGROUND OF THE INVENTION

1. Field of the Invention

This invention relates in general to well production systems, and in particular to a hydraulic seal between a tubing hanger and a wellhead member for providing hydraulic fluid to a hydraulically operated downhole safety valve.

2. Description of the Prior Art

Downhole safety valves are often used in well production systems. These downhole safety valves are connected into the production tubing string and are designed to shut off flow through the production tubing string in case of a malfunction so as to avoid a blowout.

Most downhole safety valves are hydraulically operated. Hydraulic pressure maintains the valve in the open position. Removal or interruption of the hydraulic pressure causes the safety valve to shut off flow through the production tubing string. In case of an emergency, the hydraulic pressure can be either intentionally interrupted, or might be interrupted by the catastrophe itself, thus avoiding a blowout.

A hydraulic line usually extends to the downhole safety valve from the surface to provide the safety valve with hydraulic fluid pressure. The hydraulic fluid line usually extends adjacent the production tubing string. The connection at the surface between the hydraulic fluid line and the hydraulic fluid source is often a concern because the hydraulic line usually reaches the surface on the inside of the wellhead members and must make a connection with the exterior of the wellhead members.

One common technique for providing hydraulic fluid from outside the wellhead to the hydraulic fluid line extending to the downhole safety valve is to connect the top of the hydraulic fluid line to a tubing hanger hydraulic fluid passage in the tubing hanger. The tubing hanger hydraulic fluid passage has a lateral portion which communicates with a wellhead member hydraulic fluid passage extending laterally through the wellhead member within which the tubing hanger is landed. The wellhead member hydraulic fluid passage is in turn connected to the hydraulic fluid source.

The sealing connection between the tubing hanger hydraulic fluid passage and the wellhead member hydraulic fluid passage is accomplished by the use of two circumferential annular seals. One seal extends around the circumference of the tubing hanger just above the lateral openings of the hydraulic fluid passages in the tubing hanger and wellhead member. Another seal extends around the circumference of the tubing hanger just below the lateral openings of the hydraulic fluid passages of the tubing hanger and wellhead member. Each of these two seals forms an annular seal between the circumference of the tubing hanger and the wellhead member so as to isolate an annular void between the tubing hanger and the wellhead member through which the hydraulic fluid passages can communicate.

Where the application allows, another common technique for providing hydraulic fluid from outside the wellhead to the hydraulic fluid line extending to the downhole safety valve is to obviate the need for the annular seals by providing a screwed connection directly to the tubing hanger hydraulic fluid passage. The hydraulic fluid source line is screwed through the wellhead and into a radial threaded opening of the tubing hanger hydraulic fluid passage.

Another common technique for providing hydraulic fluid from outside the wellhead to the hydraulic fluid line extending to the downhole safety valve is to have a vertical tubing hanger hydraulic fluid passage which extends the full length of the tubing hanger. The hydraulic line from the downhole safety valve connects into the bottom opening of the tubing hanger hydraulic passage. A stab from the top of the wellhead connects to the upper opening of the tubing hanger hydraulic fluid passage, thus providing hydraulic fluid to the downhole safety valve.

The annular circumferential seal method described above is the preferred method from an installation perspective because once the tubing hanger is landed into the wellhead, the hydraulic connection is complete. However, due to the large diameters involved, and the harsh conditions encountered during installation and operation, it is difficult to create reliable circumferential annular seals between the tubing hanger and wellhead member, especially for high pressure applications. Also, since the tubing hanger is often landed into the wellhead member under imperfect conditions, preventing seal damage during, and prior to, installation is also a concern.

The stab methods, both radial and vertical, described above are more suited for high pressure applications, however, installation is more complex and the stab line extending through the wellhead creates additional concerns.

A need exists for a reliable, high pressure, easy to install connection for providing hydraulic fluid from outside the wellhead to the hydraulically operated downhole safety valve.

SUMMARY OF THE INVENTION

It is the general object of the invention to provide a reliable, high pressure, easy to install connection between the hydraulic line extending from the hydraulically operated downhole safety valve of a well production system to the hydraulic fluid source at the surface.

A wellbore extends from the earth's surface downward to a fluid bearing formation located below the earth's surface. At least one casing string is suspended within the wellbore. A production tubing string extends concentrically within the casing string. The production tubing string conveys production fluids from the fluid bearing formation to the earth's surface.

An annular wellhead member is located at an upper end of the wellbore and has an inner mating surface. The wellhead member also has a hydraulic fluid passage extending laterally therethrough and having an inboard opening at the inner mating surface. A tubing hanger is connected to the upper extremity of the production tubing string and is landed concentrically within the wellhead member for suspending the production tubing string within the wellbore.

The tubing hanger has an outer mating surface which mates with the inner mating surface of the wellhead member. A production fluid passage extends through the tubing hanger for placing the production tubing string in communication with a production line.

A hydraulically actuated downhole safety valve is connected into the production tubing string for selectively interrupting fluid flow through the production tubing string. A hydraulic line extends upward from the downhole safety valve to the tubing hanger. A tubing hanger hydraulic fluid passage extends through the tubing hanger and has a first opening and an outboard opening. The first opening is connected to the hydraulic line and is in communication with the downhole safety valve. The outboard opening is located on the outer mating surface of the tubing hanger and registers with the inboard opening of the wellhead member hydraulic fluid passage. The wellhead member hydraulic fluid passage is connected to a hydraulic supply line.

A rotational alignment means aligns the outboard opening of the tubing hanger hydraulic fluid passage and the inboard opening of the wellhead member hydraulic fluid passage. A seal recess is formed in a selected one of the mating surfaces. The recess has an axis concentric with an axis of the opening and surrounds the opening in said selected one of the mating surfaces. A seal ring is concentrically located in the seal recess for providing a sealing connection between the tubing hanger hydraulic fluid passage and the wellhead member hydraulic fluid passage, wherein hydraulic fluid is supplied from the exterior of the wellhead member to the downhole safety valve.

The above as well as additional objects, features, and advantages will become apparent in the following description.

DETAILED DESCRIPTION OF THE INVENTION

Figure 1A:
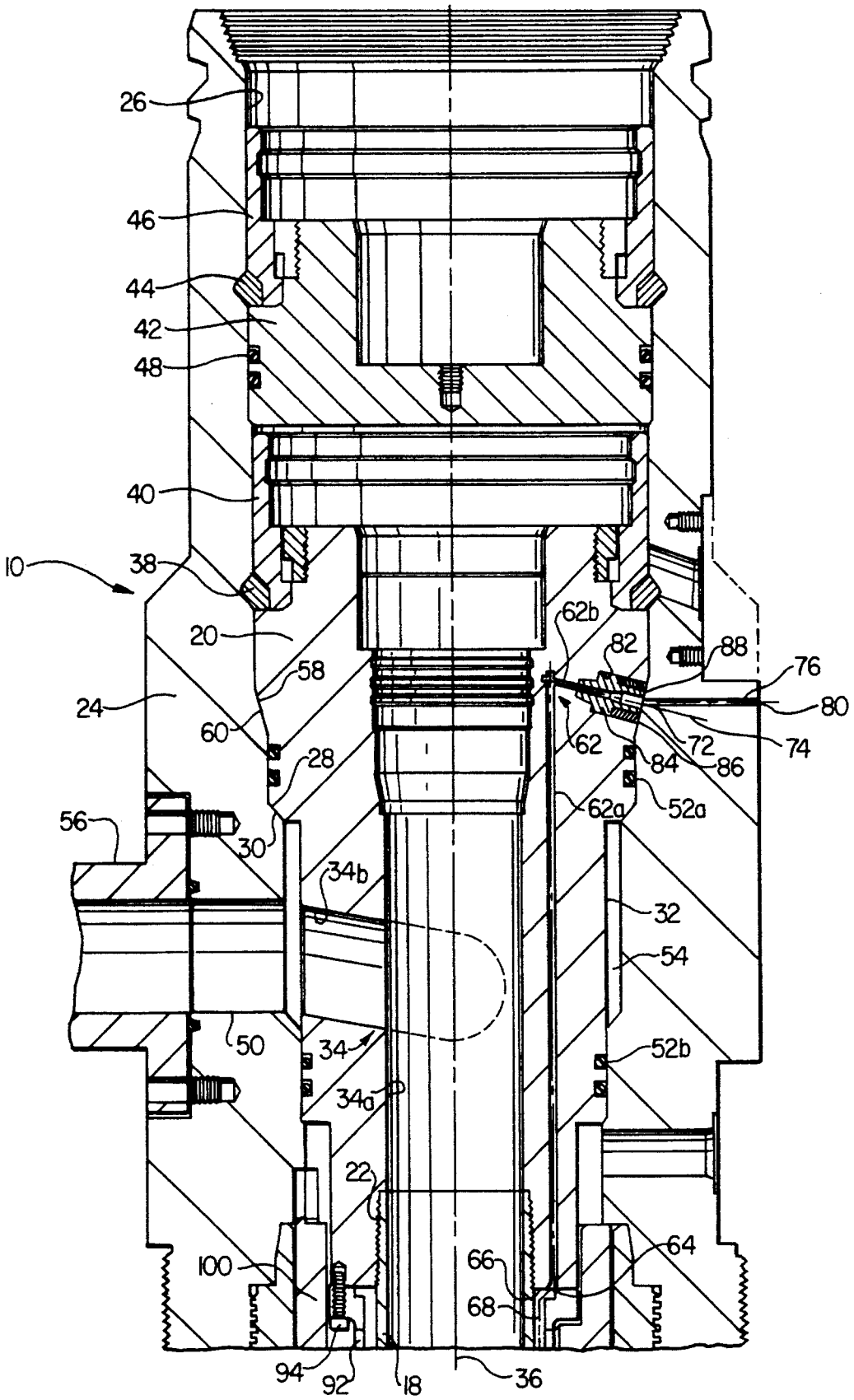
FIG. 1A is a vertical cross sectional view of an upper portion of the well production assembly of the present invention.
Figure 1B:
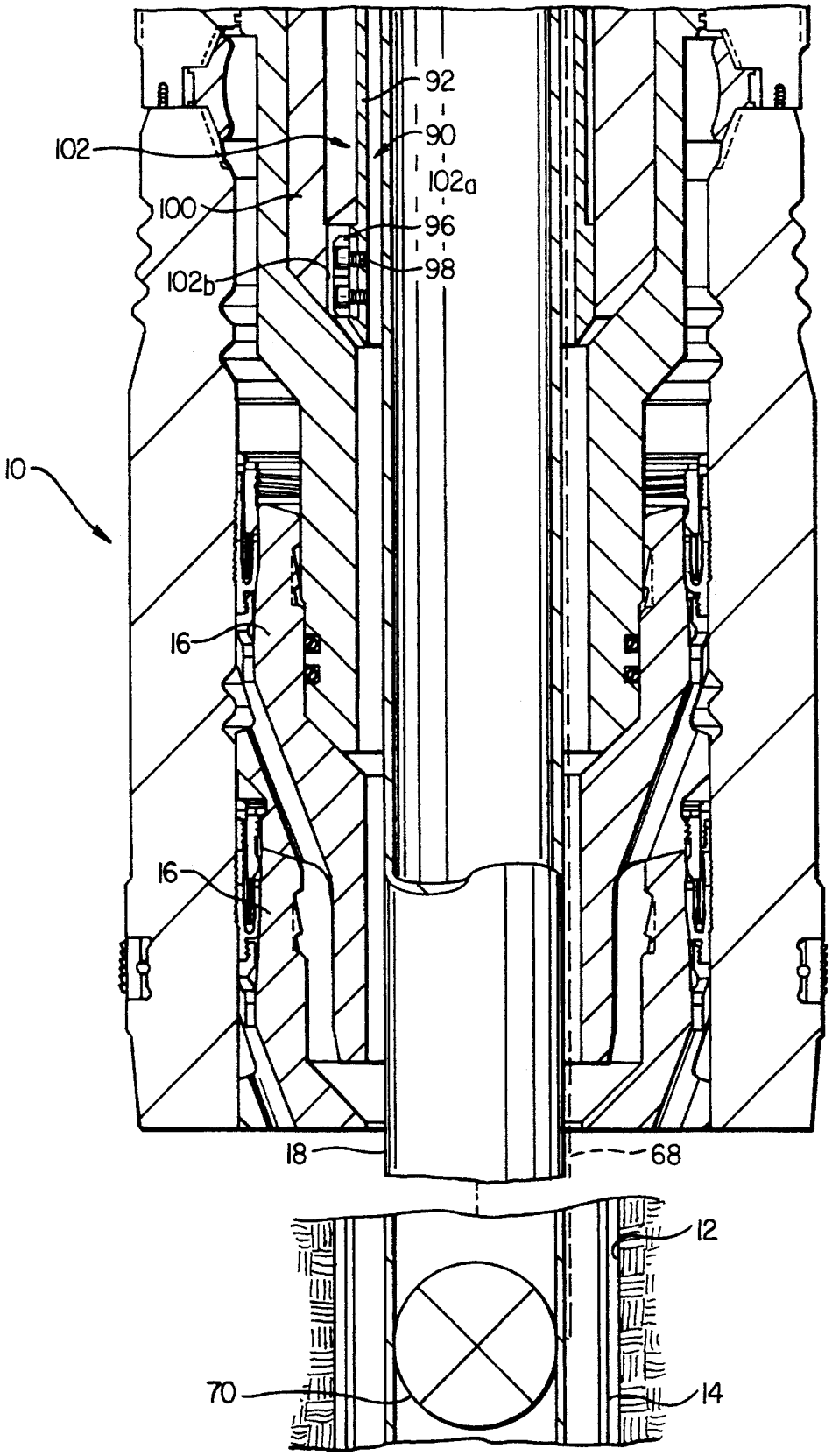
FIG. 1B is a vertical cross sectional view of a lower portion of the well production assembly of the present invention.

FIG. 1A shows the upper portion of the well production assembly 10 of the present invention. FIG. 1B shows the lower portion of the well production assembly 10 of the present invention. Referring first to FIG. 1B, wellbore 12 extends from the earth's surface downward to a fluid bearing formation (not shown) located below the earth's surface. At least one casing string 14 is conventionally suspended within the wellbore by means of casing hangers 16.

Production tubing string 18 extends concentrically within casing string 14 and conveys production fluids from the fluid bearing formation to the earth's surface. Production tubing string 18 is suspended within wellbore 12 by means of tubing hanger 20 (shown in FIG. 1A). Production tubing string 18 is connected to the lower end of tubing hanger 20 by conventional means, such as threaded connection 22.

Tubing hanger 20 is concentrically landed within wellhead member, or christmas tree head 24. Wellhead member 24 is annular in shape with bore 26 of stepped diameter extending therethrough. Upward facing landing shoulder 28 is located between two sections of different diameter of bore 26. Downward facing landing shoulder 30 is formed on the stepped outer surface 32 of tubing hanger 20. When tubing hanger 20 is landed within wellhead member 24, landing shoulders 28, 30 suspend tubing hanger 20 within wellhead member 24.

Well production assembly 10 can be of either the vertical production type or the horizontal production type. The horizontal production type is has been selected for illustration purposes herein. Tubing hanger 20 has a tubing hanger production fluid passage 34 extending therethrough. Tubing hanger production fluid passage 34 has a longitudinal portion **34*a* extending longitudinally along longitudinal axis 36 of tubing hanger 20, and a lateral portion 34*b* extending laterally from longitudinal portion 34*a* to outer surface 32 of tubing hanger 20. Lockdown latch 38 and activation sleeve 40 vertically lock tubing hanger 20 in the desired vertical position within wellhead member 24**.

A tree cap 42 is located above activation sleeve 40 and is maintained in place by lockdown latch 44 and activation sleeve 46. Tree cap 42 and seals 48 prevent production fluids from exiting through the upper end of the longitudinal portion **34*a* of production fluid passage 34 of tubing hanger 20**.

A lateral production fluid passage 50 extends through wellhead member 24. Seals **52*a* and 52*b* isolate an annular region 54 between tubing hanger 20 and wellhead member 24 so that tubing hanger production fluid passage 34 is placed in communication with wellhead member production fluid passage 50 and with production line 56**.

Bore 26 through wellhead member 24 has a concave frusto-spherical mating surface 58 extending between two sections of bore 26 of different diameters. Tubing hanger 20 has a convex frusto-spherical mating surface 60 which mates with mating surface 58 in bore 26 of wellhead member 24. Mating surfaces 58, 60 can also serve to suspend tubing hanger 20 within wellhead member 24.

A tubing hanger hydraulic fluid passage 62 extends through tubing hanger 20. Tubing hanger hydraulic fluid passage 62 has a longitudinal portion **62*a* which extends parallel to, but offset from, longitudinal axis 36 of tubing hanger 20. The lower end of tubing hanger hydraulic fluid passage 62 has a lower opening 64 located on the lower surface 66 of tubing hanger 20. A hydraulic fluid line 68 (shown schematically in FIGS. 1 and 1A) is connected to lower opening 64 and extends to downhole safety valve 70**.

Figure 2:
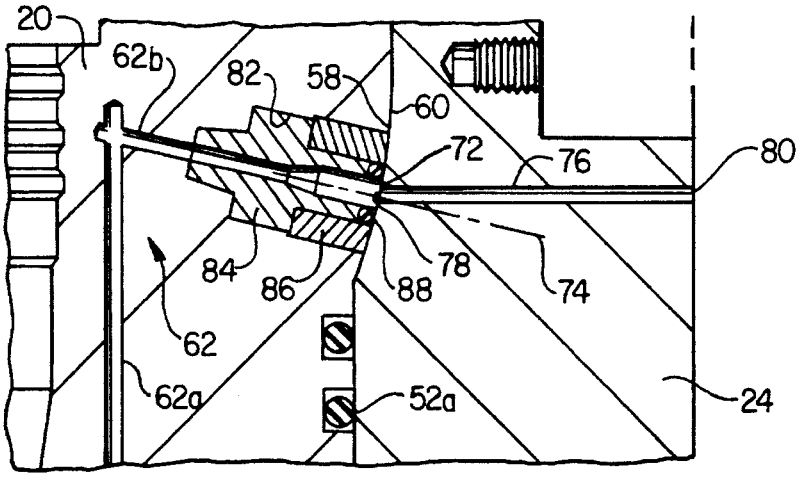
FIG. 2 is a detailed cross sectional view illustrating the sealing connection between the tubing hanger hydraulic fluid passage and the wellhead member hydraulic fluid passage of FIG. 1.

Referring now mainly to FIG. 2, at the upper end of tubing hanger hydraulic fluid passage 62 is a lateral portion **62*b* of tubing hanger hydraulic fluid passage 62 which extends from longitudinal portion 62*a* of tubing hanger hydraulic fluid passage 62 to mating surface 60 of tubing hanger 20. Lateral portion 62*b* terminates in a circular outboard opening 72 at mating surface 60. Lateral portion 62*b* extends radially and downwardly so that axis 74 of lateral portion 62*b* is perpendicular to mating surface 60 at the point where axis 74 intersects mating surface 60**.

A wellhead member hydraulic fluid passage 76 extends laterally through a wall of wellhead member 24. Wellhead member hydraulic fluid passage 76 has an inboard opening 78 located at mating surface 58 of wellhead member 24. Outer opening 80 of wellhead member hydraulic fluid passage 76 is located on the outer surface of wellhead member 24 and is connected to a hydraulic fluid source line (not illustrated).

Outboard opening 72 of tubing hanger hydraulic fluid passage 62 registers with inboard opening 78 of wellhead member hydraulic fluid passage 76. A rotational alignment means for ensuring that outboard opening 72 and inboard opening 78 are aligned is discussed in more detail herein.

A circular recess 82 is formed in one of the two mating surfaces 58, 60 around one of the two openings 72, 78. In this preferred embodiment, recess 82 is shown as being formed in mating surface 60, around outboard opening 72. Recess 82 has an axis concentric with axis 74 of lateral portion 62*b* and outboard opening 72.

An annular seal ring 84 is located within recess 82 and maintained in place by lock ring 86. Outboard portion 88 of seal 84 extends beyond the frusto-spherical mating surface 60 so that when tubing hanger 20 is landed within wellhead member 24, outboard portion 88 of seal 84 is compressed, thus resulting in a positive seal. The outboard portion 88 of seal 84 is circular in shape and forms outboard opening 72. The spherical shape of mating surface 58 on wellhead member 24 and the circular shape of outboard opening 72 formed by outboard portion 88 of seal 84 result in uniform loading of seal 84 and thus in an improved sealing action.

Referring again to FIGS. 1A and 1B, a rotational alignment means 90 ensures that outboard opening 72 and inboard opening 78 are aligned. A sleeve 92 is connected by fastening means 94 to lower surface 66 of tubing hanger 20. Connected to the lower portion of sleeve 92 is orientation key 96 which is connected to sleeve 92 by fastening means 98. A guide member 100 is fixedly connected to wellhead member 24. A keyway 102, comprising a helical portion 102*a* and a longitudinal portion 102*b*, is formed in guide member 100. The vertical portion 102*b* of keyway 102 is located at the lower end of helical portion 102*a* of keyway 102. As tubing hanger 20 is landed within wellhead member 24, key 96 enters helical portion 102*a* of keyway 102 and causes tubing hanger 20 to rotate toward the desired angular position. Once key 96 reaches the end of helical portion 102*a* of keyway 102, it enters vertical portion 102*b* of keyway 102 thus placing tubing hanger 20 in the proper vertical and rotational alignment with wellhead member 24. When tubing hanger 20 and wellhead member 24 are properly aligned, outboard opening 72 registers with inboard opening 78.

In operation, tubing hanger 20 is connected to the upper extremity of production tubing string 18. As tubing hanger 20 is lowered into wellhead member 24, production tubing string 18 is lowered through casing string 14 in wellbore 12. As tubing hanger 20 is lowered into wellhead member 24, key 96 engages helical portion 102*a* of keyway 102 and guides tubing hanger 20 as tubing hanger 20 is lowered further into wellhead member 24. Once key 96 reaches the end of helical portion 102*a* of keyway 102, key 96 enters into and engages longitudinal portion 102*b* of keyway 102 and guides tubing hanger 20 into its proper position within wellhead member 24.

In this position, outboard opening 72 registers with inboard opening 78, and tubing hanger 20 is landed within wellhead member 24. Landing shoulders 28, 30 and mating surfaces 58, 60 suspend tubing hanger 20 within wellhead member 24.

Hydraulic fluid is pumped through wellhead member hydraulic passage 76, through tubing hanger hydraulic fluid passage 62, down hydraulic line 68, and to hydraulically operated downhole safety valve 70. The hydraulic fluid pressure maintains safety valve 70 in the open position so that production fluids can flow up production tubing string 18, through tubing hanger production fluid passage 34, through wellhead production fluid passage 50, and to production line 56. In case of an emergency, the hydraulic pressure to downhole safety valve 70 is relieved, and safety valve 70, being biased toward its closed position, returns to its closed position, thus shutting off flow through production tubing string 18.

Figure 3:
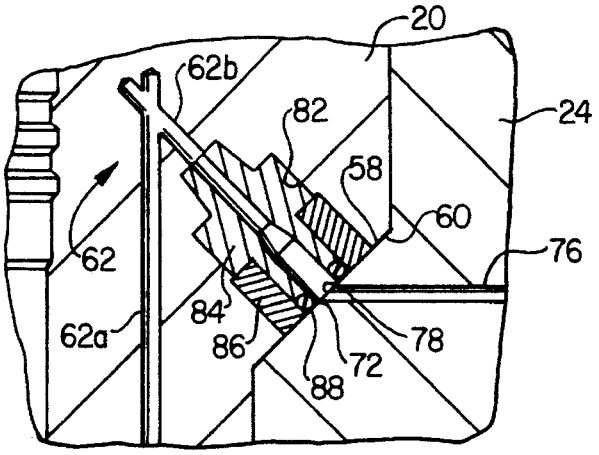
FIG. 3 is a detailed cross sectional view illustrating a second embodiment of the sealing connection shown in FIG. 2.

Referring now to FIG. 3, a second embodiment of the sealing connection between tubing hanger hydraulic fluid passage 62' and the wellhead member hydraulic fluid passage 76' is shown. In this second embodiment, mating surface 60' on tubing hanger 20', instead of being frusto-spherical in shape as shown in FIG. 2, is frusto-conical in shape as shown in FIG. 3. Likewise, mating surface 58' of wellhead member 24' is frusto-conical in shape instead of being frusto-spherical in shape as was the case in the embodiment of FIG. 2. Lateral portion 62*b'* of tubing hanger hydraulic fluid passage 62' extends radially and downwardly so that axis 74' of lateral portion 62*b'* is perpendicular to mating surface 60' at the point where axis 74' intersects mating surface 60'. Seal recess 82' seal ring 84', and lock ring 86' are identical to the corresponding components of the embodiment of FIG. 2.

Figure 4:
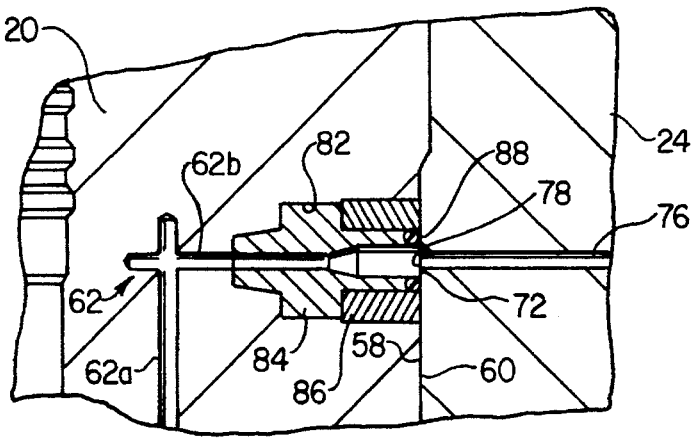
FIG. 4 is a detailed cross sectional view illustrating a third embodiment of the sealing connection shown in FIG. 2.

Referring now to FIG. 4, a third embodiment of the sealing connection between tubing hanger hydraulic fluid passage 62" and the wellhead member hydraulic fluid passage 76" is shown. In this third embodiment, mating surface 60" on tubing hanger 20", instead of being frusto-spherical in shape as shown in FIG. 2, is cylindrical in shape as shown in FIG. 4. Likewise, mating surface 58" of wellhead member 24" is cylindrical in shape instead of being frusto-spherical in shape as was the case in the embodiment of FIG. 2. Lateral portion 62*b"* of tubing hanger hydraulic fluid passage 62" extends radially so that axis 74" of lateral portion 62*b"* is perpendicular to mating surface 60". Seal recess 82", seal ring 84", and lock ring 86" are identical to the corresponding components of the embodiment of FIG. 2. In this embodiment, however, mating surfaces 58", 60" would not be capable of aiding in suspending tubing hanger 20" within wellhead member 24".

While the invention has been particularly shown and described with reference to a preferred embodiment, it will be understood by those skilled in the art that various changes in form and detail may be made therein without departing from the spirit and scope of the invention.

What is claimed is:

1. A well production assembly comprising in combination:

a wellbore extending from the earth's surface downward to a fluid bearing formation located below the earth's surface;

at least one casing string suspended within the wellbore;

a production tubing string extending concentrically within the casing string, the production tubing string conveying production fluids from the fluid bearing formation to the earth's surface;

an annular wellhead member located at an upper end of the wellbore and having an concave, frusto-spherical inner mating surface and a hydraulic fluid passage extending laterally through the wellhead member and having an inboard opening at the inner mating surface;

a tubing hanger connected to the upper extremity of the production tubing string and landed concentrically within the wellhead member for suspending the production tubing string within the wellbore, the tubing hanger having a convex, frusto-spherical outer mating surface which mates with the inner mating surface of the wellhead member;

a production fluid passage extending through the tubing hanger for placing the production tubing string in communication with a production line;

a hydraulically actuated downhole safety valve connected into the production tubing string for selectively interrupting fluid flow through the production tubing string;

a hydraulic line extending upward from the downhole safety valve to the tubing hanger;

a tubing hanger hydraulic fluid passage extending through the tubing hanger, a lower portion of the tubing hanger hydraulic fluid passage extending parallel and offset from an axis of the tubing hanger, an upper portion of the tubing hanger hydraulic fluid passage extending laterally through the tubing hanger, the tubing hanger hydraulic fluid passage having a lower opening and an outboard opening, the lower opening being connected to the hydraulic line and being in communication with the downhole safety valve, the outboard opening being located on the outer mating surface of the tubing hanger, registering with the inboard opening of the wellhead member hydraulic fluid passage, and being in communication with a hydraulic supply line, wherein hydraulic fluid is supplied from the exterior of the wellhead member to the downhole safety valve;

rotational alignment means for aligning the outboard opening of the tubing hanger hydraulic fluid passage and the inboard opening of the wellhead member hydraulic fluid passage;

a circular seal recess formed in a selected one of the mating surfaces, the recess having an axis concentric with an axis of the opening in said selected one of the mating surfaces and surrounding the opening in said selected one of the mating surfaces; and a circular seal ring concentrically located in the seal recess for providing a sealing connection between the tubing hanger hydraulic fluid passage and the wellhead member hydraulic fluid passage.

2. A well production assembly comprising in combination:

a wellbore extending from the earth's surface downward to a fluid bearing formation located below the earth's surface;

at least one casing string, suspended within the wellbore;

a production tubing string extending concentrically within the casing string, the production tubing string conveying production fluids from the fluid bearing formation to the earth's surface;

an annular wellhead member located at an upper end of the wellbore and having an inner mating surface and a hydraulic fluid passage extending laterally through the wellhead member and having an inboard opening at the inner mating surface;

a tubing hanger connected to the upper extremity of the production tubing string and landed concentrically within the wellhead member for suspending the production tubing string within the wellbore, the tubing hanger having an outer mating surface which mates with the inner mating surface of the wellhead member;

a production fluid passage extending through the tubing hanger for placing the production tubing string in communication with a production line;

a hydraulically actuated downhole safety valve connected into the production tubing string for selectively interrupting fluid flow through the production tubing string;

a hydraulic line extending upward from the downhole safety valve to the tubing hanger;

a tubing hanger hydraulic fluid passage extending through the tubing hanger and having a lower opening and an outboard opening, the lower opening being connected to the hydraulic line and being in communication with the downhole safety valve, the outboard opening being located on the outer mating surface of the tubing hanger, registering with the inboard opening of the wellhead member hydraulic fluid passage, and being in communication with a hydraulic supply line, wherein hydraulic fluid is supplied from the exterior of the wellhead member to the downhole safety valve;

rotational alignment means for aligning the outboard opening of the tubing hanger hydraulic fluid passage and the inboard opening of the wellhead member hydraulic fluid passage;

a seal recess formed in a selected one of the mating surfaces, the recess having an axis concentric with an axis of the opening in said selected one of the mating surfaces and surrounding the opening in said selected one of the mating surfaces; and a seal ring concentrically located in the seal recess for providing a sealing connection between the tubing hanger hydraulic fluid passage and the wellhead member hydraulic fluid passage; and wherein the outer mating surface of the tubing hanger comprises a convex, frusto-spherical surface, and the inner mating surface of the wellhead member comprises a concave, frusto-spherical surface.

3. A well production assembly comprising in combination:

a wellbore extending from the earth's surface downward to a fluid bearing formation located below the earth's surface;

at least one casing string suspended within the wellbore;

a production tubing string extending concentrically within the casing string, the production tubing string conveying production fluids from the fluid bearing formation to the earth's surface;

an annular wellhead member located at an upper end of the wellbore and having an inner mating surface and a hydraulic fluid passage extending laterally through the wellhead member and having an inboard opening at the inner mating surface;

a tubing hanger connected to the upper extremity of the production tubing string and landed concentrically within the wellhead member for suspending the production tubing string within the wellbore, the tubing hanger having an outer mating surface which mates with the inner mating surface of the wellhead member;

a production fluid passage extending through the tubing hanger for placing the production tubing string in communication with a production line;

a hydraulically actuated downhole safety valve connected into the production tubing string for selectively interrupting fluid flow through the production tubing string;

a hydraulic line extending upward from the downhole safety valve to the tubing hanger;

a tubing hanger hydraulic fluid passage extending through the tubing hanger and having a lower opening and an outboard opening, the lower opening being connected to the hydraulic line and being in communication with the downhole safety valve, the outboard opening being located on the outer mating surface of the tubing hanger, registering with the inboard opening of the wellhead member hydraulic fluid passage, and being in communication with a hydraulic supply line, wherein hydraulic fluid is supplied from the exterior of the wellhead member to the downhole safety valve;

rotational alignment means for aligning the outboard opening of the tubing hanger hydraulic fluid passage and the inboard opening of the wellhead member hydraulic fluid passage;

a seal recess formed in a selected one of the mating surfaces, the recess having an axis concentric with an axis of the opening in said selected one of the mating surfaces and surrounding the opening in said selected one of the mating surfaces; and a seal ring concentrically located in the seal recess for providing a sealing connection between the tubing hanger hydraulic fluid passage and the wellhead member hydraulic fluid passage; and wherein the outer mating surface of the tubing hanger comprises a convex, frusto-spherical surface, the inner mating surface of the wellhead member comprises a concave, frusto-spherical surface, and the seal recess and seal ring are circular in shape so as to provide uniform loading of the seal.

4. A well production assembly comprising in combination:

a wellbore extending from the earth's surface downward to a fluid bearing formation located below the earth's surface;

at least one casing string suspended within the wellbore;

a production tubing string extending concentrically within the casing string, the production tubing string conveying production fluids from the fluid bearing formation to the earth's surface;

an annular wellhead member located at an upper end of the wellbore and having an concave, frusto-spherical inner mating surface and a hydraulic fluid passage extending laterally through the wellhead member and having an inboard opening at the inner mating surface;

a tubing hanger connected to the upper extremity of the production tubing string and landed concentrically within the wellhead member for suspending the production tubing string within the wellbore, the tubing hanger having a convex, frusto-spherical outer mating surface which mates with the inner mating surface of the wellhead member;

a production fluid passage extending through the tubing hanger for placing the production tubing string in communication with a production line;

a hydraulically actuated downhole safety valve connected into the production tubing string for selectively interrupting fluid flow through the production tubing string;

a hydraulic line extending upward from the downhole safety valve to the tubing hanger;

a tubing hanger hydraulic fluid passage extending through the tubing hanger, a lower portion of the tubing hanger hydraulic fluid passage extending parallel and offset from an axis of the tubing hanger, an upper portion of the tubing hanger hydraulic fluid passage extending laterally through the tubing hanger, the tubing hanger hydraulic fluid passage having a lower opening and an outboard opening, the lower opening being connected to the hydraulic line and being in communication with the downhole safety valve, the outboard opening being located on the outer mating surface of the tubing hanger, registering with the inboard opening of the wellhead member hydraulic fluid passage, and being in communication with a hydraulic supply line, wherein hydraulic fluid is supplied from the exterior of the wellhead member to the downhole safety valve;

rotational alignment means for aligning the outboard opening of the tubing hanger hydraulic fluid passage and the inboard opening of the wellhead member hydraulic fluid passage;

a circular seal recess formed in a selected one of the mating surfaces, the recess having an axis concentric with an axis of the opening in said selected one of the mating surfaces and surrounding the opening in said selected one of the mating surfaces; and a circular seal ring concentrically located in the seal recess for providing a sealing connection between the tubing hanger hydraulic fluid passage and the wellhead member hydraulic fluid passage; and wherein the rotational alignment means comprises a key fixedly connected to the tubing hanger and an orientation keyway in the wellhead member wherein, as the tubing hanger is landed into the wellhead member, the key and orientation keyway guide the tubing hanger into proper alignment with the wellhead member.

5. A well production assembly comprising in combination:

a wellbore extending from the earth's surface downward to a fluid bearing formation located below the earth's surface;

at least one casing string suspended within the wellbore;

a production tubing string extending concentrically within the casing string, the production tubing string conveying production fluids from the fluid bearing formation to the earth's surface;

an annular wellhead member located at an upper end of the wellbore and having an concave, frusto-spherical inner mating surface and a hydraulic fluid passage extending laterally through the wellhead member and having an inboard opening at the inner mating surface;

a tubing hanger connected to the upper extremity of the production tubing string and landed concentrically within the wellhead member for suspending the production tubing string within the wellbore, the tubing hanger having a convex, frusto-spherical outer mating surface which mates with the inner mating surface of the wellhead member;

a production fluid passage extending through the tubing hanger for placing the production tubing string in communication with a production line;

a hydraulically actuated downhole safety valve connected into the production tubing string for selectively interrupting fluid flow through the production tubing string;

a hydraulic line extending upward from the downhole safety valve to the tubing hanger;

a tubing hanger hydraulic fluid passage extending through the tubing hanger, a lower portion of the tubing hanger hydraulic fluid passage extending parallel and offset from an axis of the tubing hanger, an upper portion of the tubing hanger hydraulic fluid passage extending laterally through the tubing hanger, the tubing hanger hydraulic fluid passage having a lower opening and an outboard opening, the lower opening being connected to the hydraulic line and being in communication with the downhole safety valve, the outboard opening being located on the outer mating surface of the tubing hanger, registering with the inboard opening of the wellhead member hydraulic fluid passage, and being in communication with a hydraulic supply line, wherein hydraulic fluid is supplied from the exterior of the wellhead member to the downhole safety valve;

rotational alignment means for aligning the outboard opening of the tubing hanger hydraulic fluid passage and the inboard opening of the wellhead member hydraulic fluid passage;

a circular seal recess formed in a selected one of the mating surfaces, the recess having an axis concentric with an axis of the opening in said selected one of the mating surfaces and surrounding the opening in said selected one of the mating surfaces; and a circular seal ring concentrically located in the seal recess for providing a sealing connection between the tubing hanger hydraulic fluid passage and the wellhead member hydraulic fluid passage; and wherein the rotational alignment means comprises:

a key fixedly connected to the tubing hanger;

an orientation keyway in the wellhead member, the orientation keyway having a helical portion and a longitudinal portion, wherein, as the tubing hanger is landed into the wellhead member, the key follows the helical portion of the orientation keyway and rotates the tubing hanger, and when the key engages the longitudinal portion of the orientation keyway it locks the tubing hanger in proper rotational alignment with the wellhead member.

6. A well production assembly comprising in combination:

a wellbore extending from the earth's surface downward to a fluid bearing formation located below the earth's surface;

at least one casing string suspended within the wellbore;

a production tubing string extending concentrically within the casing string, the production tubing string conveying production fluids from the fluid bearing formation to the earth's surface;

an annular wellhead member located at an upper end of the wellbore and having an inner mating surface and a hydraulic fluid passage extending laterally through the wellhead member and having an inboard opening at the inner mating surface;

a tubing hanger connected to the upper extremity of the production tubing string and landed concentrically within the wellhead member for suspending the production tubing string within the wellbore, the tubing hanger having an outer mating surface which mates with the inner mating surface of the wellhead member;

a production fluid passage extending through the tubing hanger for placing the production tubing string in communication with a production line;

a hydraulically actuated downhole safety valve connected into the production tubing string for selectively interrupting fluid flow through the production tubing string;

a hydraulic line extending upward from the downhole safety valve to the tubing hanger;

a tubing hanger hydraulic fluid passage extending through the tubing hanger and having a lower opening and an outboard opening, the lower opening being connected to the hydraulic line and being in communication with the downhole safety valve, the outboard opening being located on the outer mating surface of the tubing hanger, registering with the inboard opening of the wellhead member hydraulic fluid passage, and being in communication with a hydraulic supply line, wherein hydraulic fluid is supplied from the exterior of the wellhead member to the downhole safety valve;

rotational alignment means for aligning the outboard opening of the tubing hanger hydraulic fluid passage and the inboard opening of the wellhead member hydraulic fluid passage;

a seal recess formed in a selected one of the mating surfaces, the recess having an axis concentric with an axis of the opening in said selected one of the mating surfaces and surrounding the opening in said selected one of the mating surfaces; and a seal ring concentrically located in the seal recess for providing a sealing connection between the tubing hanger hydraulic fluid passage and the wellhead member hydraulic fluid passage; and wherein the rotational alignment means comprises a key fixedly connected to the tubing hanger and an orientation keyway in the wellhead member wherein, as the tubing hanger is landed into the wellhead member, the key and orientation keyway guide the tubing hanger into proper alignment with the wellhead member.

7. A well production assembly comprising in combination:

a wellbore extending from the earth's surface downward to a fluid bearing formation located below the earth's surface;

at least one casing string suspended within the wellbore;

a production tubing string extending concentrically within the casing string, the production tubing string conveying production fluids from the fluid bearing formation to the earth's surface;

an annular wellhead member located at an upper end of the wellbore and having an inner mating surface and a hydraulic fluid passage extending laterally through the wellhead member and having an inboard opening at the inner mating surface;

a tubing hanger connected to the upper extremity of the production tubing string and landed concentrically within the wellhead member for suspending the production tubing string within the wellbore the tubing hanger having an outer mating surface which mates with the inner mating surface of the wellhead member;

a production fluid passage extending through the tubing hanger for placing the production tubing string in communication with a production line;

a hydraulically actuated downhole safety valve connected into the production tubing string for selectively interrupting fluid flow through the production tubing string;

a hydraulic line extending upward from the downhole safety valve to the tubing hanger;

a tubing hanger hydraulic fluid passage extending through the tubing hanger and having a lower opening and an outboard opening, the lower opening being connected to the hydraulic line and being in communication with the downhole safety valve, the outboard opening being located on the outer mating surface of the tubing hanger, registering with the inboard opening of the wellhead member hydraulic fluid passage, and being in communication with a hydraulic supply line, wherein hydraulic fluid is supplied from the exterior of the wellhead member to the downhole safety valve;

rotational alignment means for aligning the outboard opening of the tubing hanger hydraulic fluid passage and the inboard opening of the wellhead member hydraulic fluid passage;

a seal recess formed in a selected one of the mating surfaces, the recess having an axis concentric with an axis of the opening in said selected one of the mating surfaces and surrounding the opening in said selected one of the mating surfaces; and a seal ring concentrically located in the seal recess for providing a sealing connection between the tubing hanger hydraulic fluid passage and the wellhead member hydraulic fluid passage; and wherein the rotational alignment means comprises:

a key fixedly connected to the tubing hanger;

an orientation keyway in the wellhead member, the orientation keyway having a helical portion and a longitudinal portion, wherein, as the tubing hanger is landed into the wellhead member, the key follows the helical portion of the orientation keyway and rotates the tubing hanger, and when the key engages the longitudinal portion of the orientation keyway it locks the tubing hanger in proper rotational alignment with the wellhead member.

* * * * *